United States Patent [19]

Rovin et al.

[11] 4,117,789

[45] Oct. 3, 1978

[54] AUTOMATIC, IN SITU BOBBIN SPOOL LOADING

[75] Inventors: Herman Rovin, Norwalk, Conn.; Lawrence J. Levine, Valley Stream, N.Y.; Theodore Opuszenski, Darien, Conn.; Joseph Pellicano, Greenwich, Conn.; Alan F. Swenson, Norwalk, Conn.

[73] Assignee: Automatech Industries, Inc., Bridgeport, Conn.

[21] Appl. No.: 833,178

[22] Filed: Sep. 14, 1977

[51] Int. Cl.[2] ..... D05B 57/26; D05B 37/04; D05B 45/00; H03K 17/00

[52] U.S. Cl. ..... 112/181; 112/279; 112/277; 112/285; 112/186; 242/20; 328/69

[58] Field of Search ..... 112/186, 181, 279, 285, 112/277; 242/20, 21, 22, 23, 24; 328/28, 69

[56] References Cited

U.S. PATENT DOCUMENTS

| | | | |
|---|---|---|---|
| 3,509,840 | 5/1970 | Rovin | 112/181 |
| 3,582,796 | 6/1971 | Shifflet, Jr. | 328/69 |
| 3,628,129 | 12/1971 | Riley | 328/69 X |
| 3,628,480 | 12/1971 | Van Ness | 112/181 |
| 3,740,588 | 6/1973 | Stratton et al. | 328/69 X |
| 3,832,960 | 9/1974 | Mayer et al. | 112/279 X |
| 4,002,130 | 1/1977 | Rovin et al. | 112/186 X |

*Primary Examiner*—Werner H. Schroeder
*Assistant Examiner*—Andrew M. Falik
*Attorney, Agent, or Firm*—Mandeville and Schweitzer

[57] ABSTRACT

The disclosure relates to the automatic refilling of a bobbin spool, in a lock stitch type sewing machine, in the interval between the loading of work units. After sewing of a predetermined work unit, consisting of a single workpiece, or several workpieces, a premeasured thread length on the bobbin spool is exhausted. While the machine operator places a new work unit in position for sewing, the mechanism of the invention refills the empty bobbin spool, in situ, with a precisely measured length of bobbin thread, drawn from an effectively continuous supply source. The mechanisms provided for this purpose, in and of themselves generally known, are arranged in an improved, simplified and more compact arrangement, suitable for incorporation in a variety of commercial lock stitch type sewing machines available to the trade. In conjunction with the new mechanism, there is provided an advantageous, economically feasible control system for effecting highly precise measurement of the bobbin thread, as it is fed to the bobbin spool during the reloading operation. precise control over the thread length guarantees that there is sufficient thread in the bobbin spool to complete the work unit, while avoiding wastage of thread tails.

17 Claims, 12 Drawing Figures

90
91
92
93
14
22
31
45
44
24
42
27
47
46
75
28
25
23
26
21
32
29
35
30
34
33
36
37
40
94
96
95
93
92

AUTOMATIC, IN SITU BOBBIN SPOOL LOADING

Related Cases

This application is closely related to U.S. Pat. No. 3,509,840, granted May 5, 1970 to Herman Rovin, the content of which is incorporated herein by reference. The Rovin patent discloses an automatic bobbin spool loader whose intended function is generally the same as that of the mechanism and control of the present application. The subject matter of the present invention is directed to specific improvements in the subject matter of the Rovin patent, to adapt the Rovin invention more effectively as an attachment to high speed, commercially available lock stitch sewing machines of standard types.

SUMMARY AND BACKGROUND OF THE INVENTION

In the operation of lock stitch type sewing machines, it is necessary to provide not only a primary thread supply to the sewing needle, but also a secondary supply of thread to a bobbin, located on the opposite side of the work from the needle. In the sewing operation, the needle penetrates the work, carrying a length of thread from the main supply. Before the needle is retracted, the thread is engaged from below the work, and a loop of the thread is passed around the bobbin in order to engage the bobbin thread and form the desired lock stitch. Because of the requirement that the loop of the needle thread be passed completely around the bobbin, the bobbin and its thread supply are necessarily quite small. In a high speed industrial sewing operation, the bobbin supply normally is exhausted at frequent intervals. Under normal circumstances, this results in at least the inconvenience of stopping the sewing operation while a new bobbin in inserted in the bobbin case and the empty bobbin is removed for refilling. Especially undesirable, moreover, is the prospect of exhausting the bobbin supply during the sewing of a workpiece. This necessitates restarting the sewing operation in the middle of the workpiece. For many products, that would destroy the value of the goods (e.g., where the stitching is highly visible, as in the lapel of a jacket, for example). To avoid such an eventuality, it is necessary to reload the machine with a full bobbin considerably in advance of exhaustion of the supply of the old, so that bobbins are changed oftener than necessary and there is a substantial wastage of bobbin thread.

Pursuant to the teachings of the Rovin U.S. Pat. No. 3,509,840 previously referred to and incorporated herein by reference, the bobbin spool is loaded with a predetermined length of thread, calculated to be just enough to complete a given work unit, consisting of a single workpiece, if relatively large, or a succession of workpieces, if relatively small. At the end of the sewing of the predetermined work unit, the bobbin supply is exhausted, with only a minimum "tail" being provided to accommodate normal operating tolerances. In a typical case, a couple of inches of such tail may be adequate. After the sewing of the work unit has been completed, and while a new work unit is being put into place, a loading mechanism moves into place with respect to the bobbin spool, rotating the spool at extremely high speed through an air-driven turbine arrangement of which the spool itself forms the moving part, and advancing a thread onto the spool, to be picked up and driven by the spool hub, by means of a hollow loading tube through which thread is advanced by the flow of air. After a predetermined length of thread is wound on to the bobbin spool, a process that is accomplished in about one second of time or less, the loading mechanism retracts, the thread is guided under the bobbin spring, and the thread is then severed from the bobbin supply source, permitting the next sewing cycle to commence.

In accordance with the present invention, a mechanism is provided to perform the functions described above, which is both highly compact and relatively simplified in its construction, enabling it to be produced on an economical basis and to be mounted as an attachment on various lock stitch type sewing machines of commercially available design. The mechanism of the present invention incorporates a short stroke, double acting air cylinder which, in its retracting and extending strokes, serves to execute a multiplicity of functions involved in the reloading of the bobbin spool. In timed sequence, these include the following primary functions: (1) Initiation of turbine air to rotate the bobbin spool at high speed; (2) direction of air through the thread-loading tube; (3) advancement of the thread-loading tube into loading position with respect to the bobbin spool; (4) release of the thread for injection onto the bobbin spool; (5) retraction of the loading tube; (6) manipulation of the thread under the bobbin case tension spring (for controlling bobbin thread tension during sewing); (7) return of the thread manipulating mechanism; (8) severing of the thread from the supply source; (9) clamping the thread within the loading mechanism, in preparation for a further cycle. The relatively complex series of operations thus described, is accomplished in a single reciprocation of a fluid actuator, by means of a compact, relatively easily manufactured mechanism, which is of sufficiently compact form to be easily received underneath the sewing plate of a conventional lock stitch type sewing machine.

In some commercially available lock stitch type sewing machines, the bobbin is mounted for rotation about a vertical axis; in others, it is mounted for rotation about a horizontal axis. The mechanism of the invention is readily adaptable to either arrangement, with minimum alterations in the mounting arrangements.

In accordance with another significant aspect of the invention, a novel and improved, economical control arrangement is provided for effecting precise measurement of the thread, as it is being fed on to the bobbin spool, and for terminating the loading operation after a predetermined length of thread has been wound on the spool. The control system is readily adjustable to provide for variation in the length of the bobbin thread to accommodate different working units. The control system of the invention includes means for generating an electrical pulse in accordance with the advance of a predetermined unit length of thread. Control over the loading operation is not accomplished, however, by merely counting the pulses just generated, as systems for this purpose would be unduly costly. The system of the invention, on the other hand, includes highly simplified, inexpensive yet reliable solid-state circuit arrangements which shape and form the pulsed electrical signals to control pulses of uniform size and shape, independent of the fact that the pulses as originally generated vary both as to amplitude and as to duration. The uniformly shaped pulses are then accumulated in an integrator circuit, and the output of the integrator circuit is summed with an adjustable control voltage of opposite polarity, the control voltage being set in accordance with the desired amount of thread to be loaded on to the spool. The output of the voltage summing junction is fed to a bi-stable comparator circuit, including a high-gain amplifier. As soon as the integrated voltage even slightly exceeds the control voltage, the bi-stable comparator circuit flips to the opposite polarity and executes control functions to terminate the loading operation. Among these control functions are instant engagement of the thread by a braking device and initiation of the reverse stroke of the air actuator.

The circuit arrangement of the invntion provides a high degree of precision for the purposes intended, yet may be manufactured with great economy, so that the entire system, including the mechanical mechanisms in the related controls, may be marketed on an economically attractive basis.

For a more complete understanding of the above and other features and advantages of the invention, reference should be made to the following detailed description of a preferred embodiment and to the accompanying drawings.

DESCRIPTION OF A PREFERRED EMBODIMENT

Figure 1:
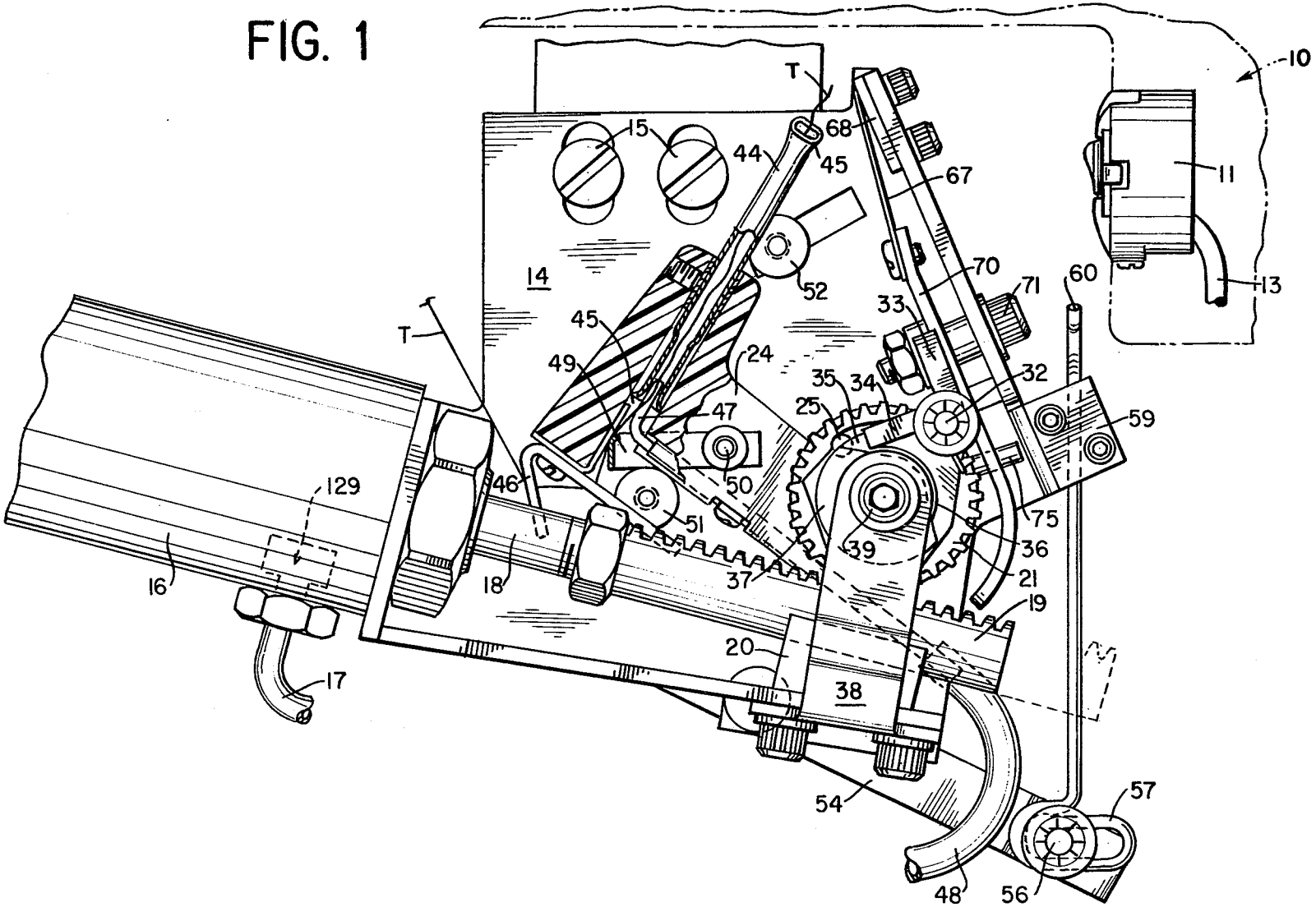
FIG. 1 is a side elevational view, with parts broken away, of an automatic, in situ bobbin loading mechanism according to the present invention.
Figure 2:
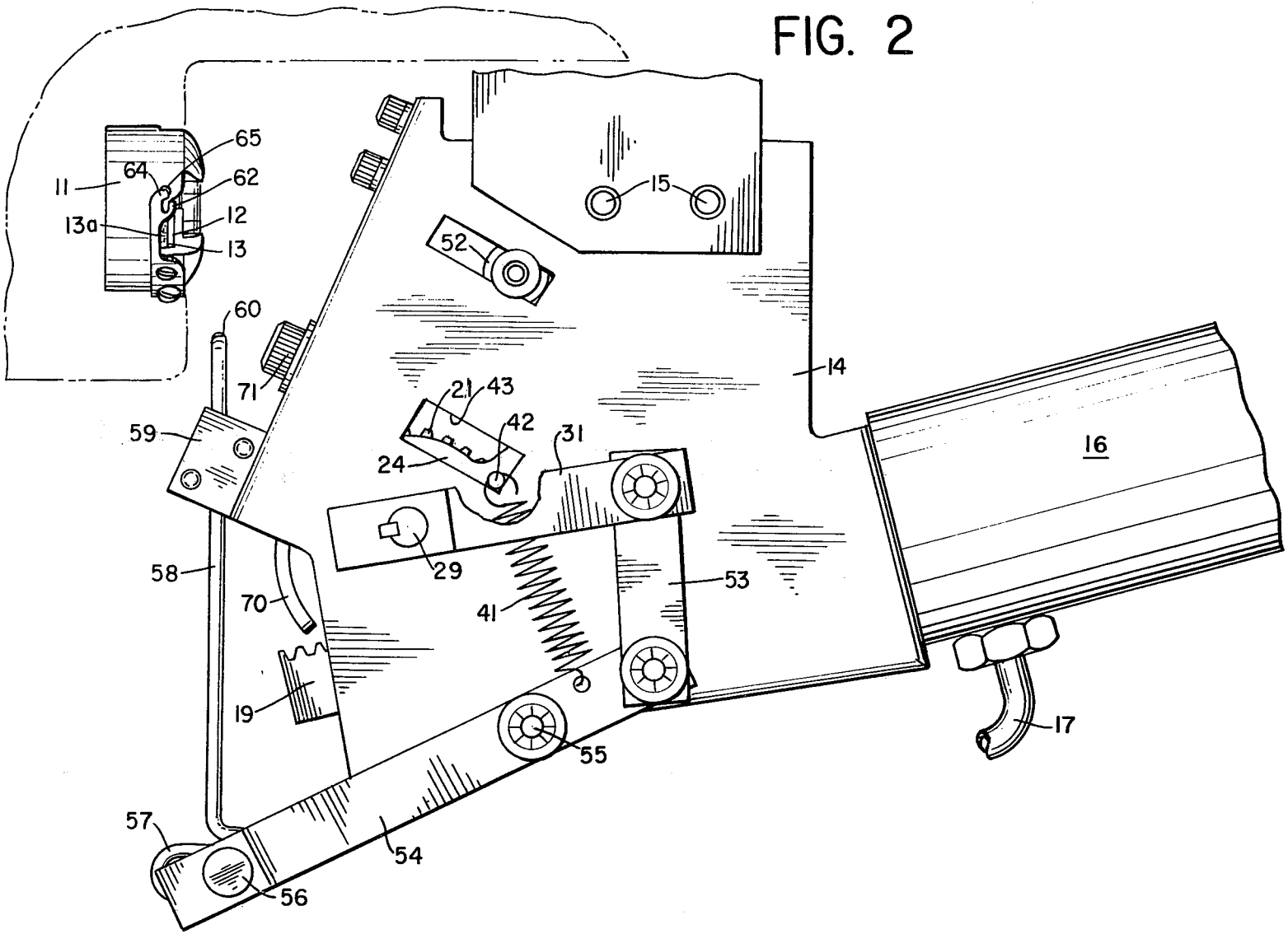
FIG. 2 is an elevational view of the mechanism of FIG. 1, taken from the opposite side thereof.
Figure 7:
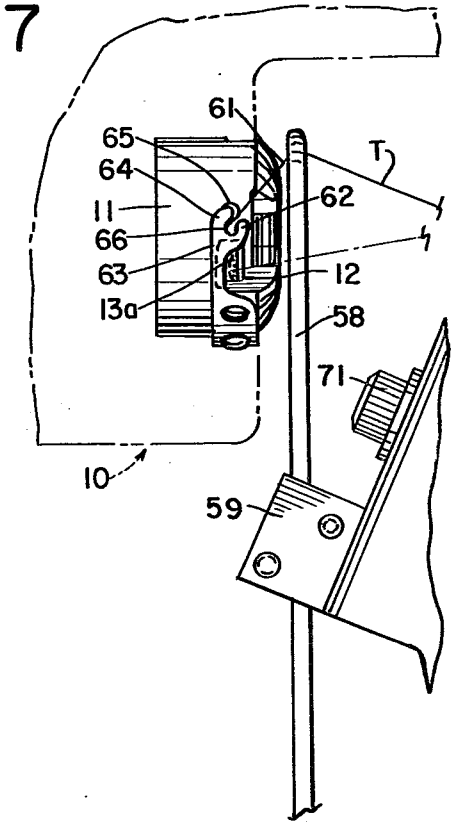
FIG. 7 is a fragmentary end elevational view of the mechanism in the position shown in FIG. 6.

Referring now to the drawings, and initially to FIG. 1 thereof, the reference numeral 10 designates in a general way a lock stitch type sewing machine of a generally conventional, commercially available type. The sewing machine 10 includes appropriate means for mounting a bobbin case 11, containing and rotatably supporting a bobbin spool 12 (FIG. 2). Apart from its conventional function of retaining a small supply of bobbin thread, the spool 12 is constructed in accordance with teachings of the Rovin '840 patent, to include an end surface structure forming turbine blades, enabling the bobbin to be rotated at high speed during bobbin reloading operations, by the discharge of high velocity air against the end face of the spool, through a conduit 13. On the hub of the spool provisions are made for entangling engagement with the leading end of a thread injected toward the hub of the rotating spool. To advantage, this may be achieved by providing on the hub a layer of a "fuzzy" material 13*a* (FIG. 7). A small piece of Velcro brand fastening material may be appropriate for the purpose.

In the form of the device illustrated in FIG. 1, the bobbin case is mounted for rotation on a horizontal axis. However, in machines in which the bobbin is mounted for rotation on a vertical axis, the loading mechanism may be reoriented, so that the relationship of the mechanism to the bobbin axis remains generally the same.

The loading mechanism of the invention is generally self-contained on a mounting bracket 14, which is secured to the sewing machine frame by appropriate mounting means (not shown) and has limited adjustability through screws 15 to achieve proper alignment with respect to the bobbin case 11. The bracket 14 mounts a double acting air cylinder 16, which may be of a conventional, commercially available type provided with a built-in air valve operable automatically at the commencement of its retracting stroke to admit the flow of air through a discharge tube 17, for purposes to be described. Such air flow is subsequently terminated at the end of the extending stroke of the cylinder.

Mounted on the end of the actuator rod 18 is a rack 19, which is guided and supported in a slide bearing 20 and is arranged to mesh with a drive gear 21. As reflected best in FIG. 4, the drive gear 21 is mounted for rotation on a sleeve 22 rigidly mounted on and extending through the bracket 14. The sleeve 22 mounts, in addition to the drive gear 21, a timing disc 23 and a loading arm 24. The gear, disc, and arm all freely rotate on the sleeve 22 and the operation thereof is controlled primarily by the rack 19 in conjunction with a return spring. Thus, a pin 25 on the timing disc is received in an arcuate slot 26 in the drive gear, providing for the disc to be driven by the gear, subject to lost motion action provided by the elongated slot 26. Similarly, the loading arm 24 carries a pin 27 which is received within an elongated arcuate slot 28 in the timing disc.

Journaled within the sleeve 22 is a rock shaft 29 mounting a rocker plate 30 at its outer end. The rock shaft 29 extends through the sleeve, to the opposite side of the mounting bracket 14, and is keyed to a lever arm 31, whose function will be later described.

Figures 4, 10, 11:
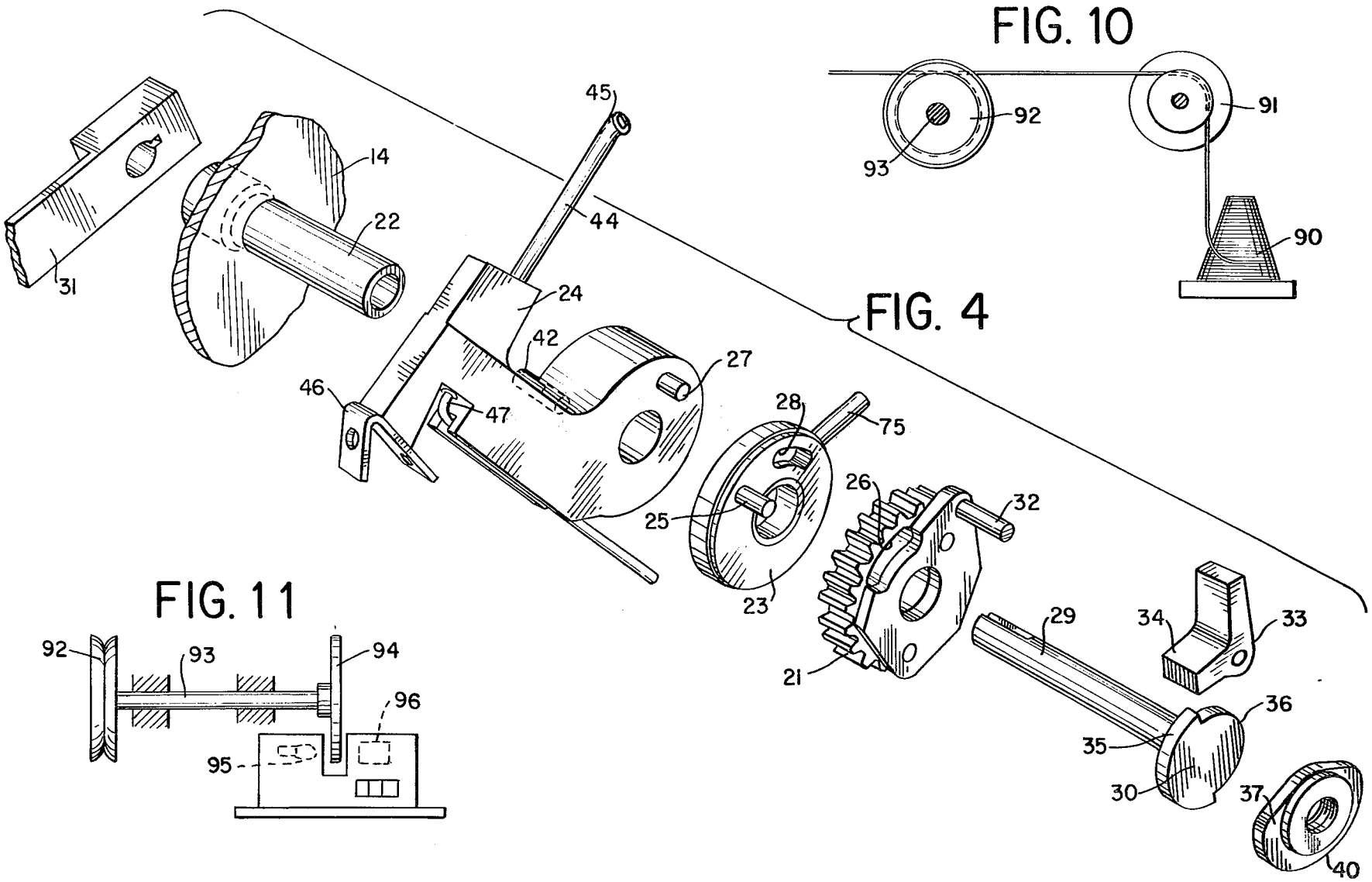
FIG. 4 is an exploded, perspective view of a sequential operation mechanism, forming a subassembly of the mechanism of FIG. 1.
FIGS. 10 and 11 are schematic illustrations showing an arrangement for the supply of thread to the bobbin loading mechanism, through a braking device and measuring wheel for controlling the length of the thread supplied.

As best shown in FIG. 4, the drive gear 21 carries a pin 32 on which is mounted a drive pawl 33. A torsion spring (not shown) urges the pawl 33 to rotate in a counterclockwise direction, tending to cause the drive arm 34 of the pawl to bear against the edge of the rocker plate 30. Thus, when the drive gear 21 is rotated first in clockwise direction, and then in a counterclockwise direction, the drive arm 34 of the pawl is carried beyond a shoulder 35 on the rocker plate and drops down onto the lower surface 36 thereof. Upon return rotational movement of the drive gear 21, in a counterclockwise direction, the rocker plate is engaged and driven by the pawl 33.

Figure 3:
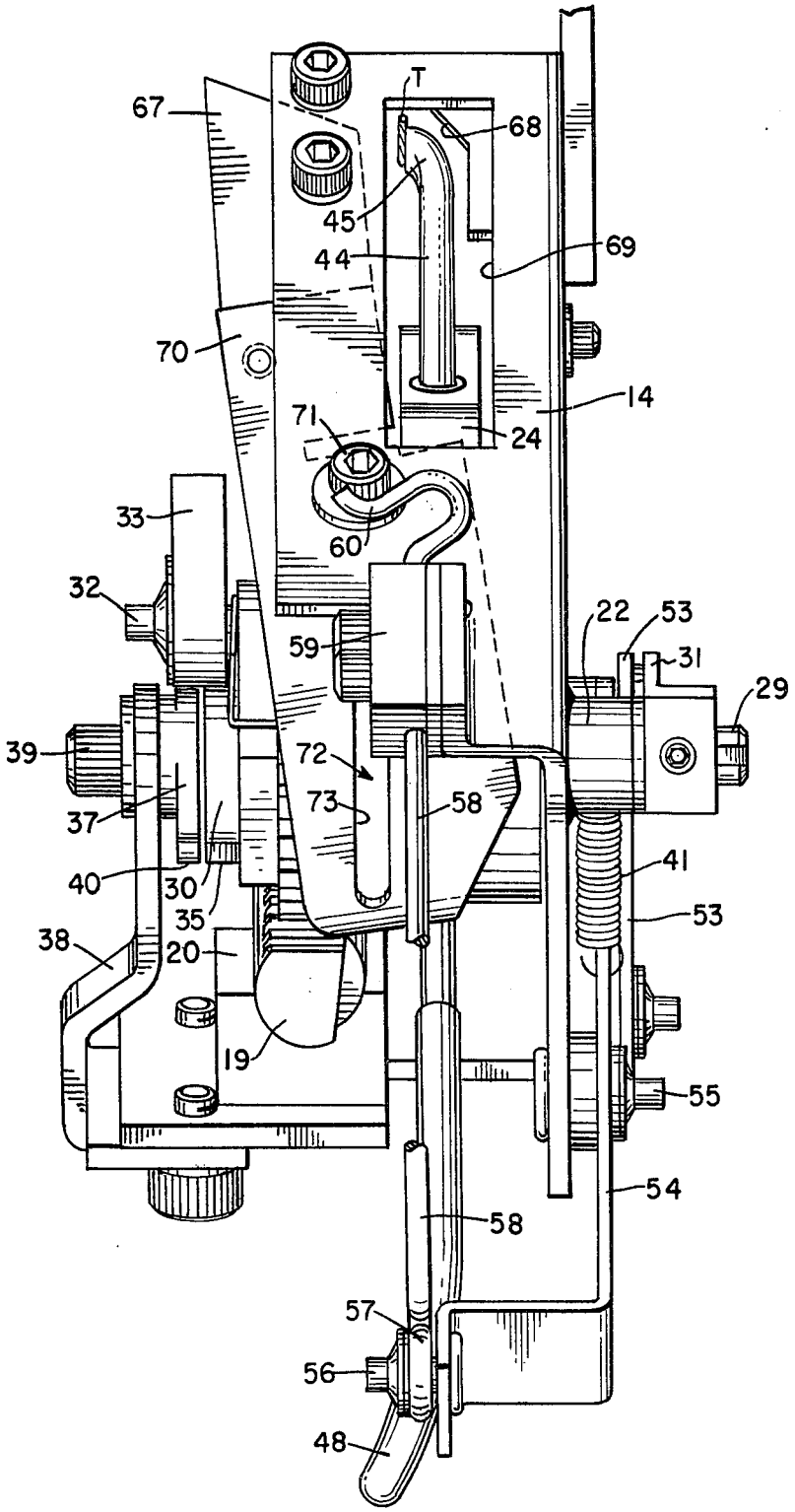
FIG. 3 is an end elevational view of the mechanism of FIG. 1.

As shown best in FIG. 3, the pawl 33 is positioned to overlie the rocker plate 30 and also a control cam 37. The cam 37 is rigidly but adjustably secured to a bracket arm 38, by means of a screw 39, such that the control cam 37 is positioned directly opposite the end of the rocker plate 30. The control cam 37 has a lifting surface 40 (FIG. 4) which functions to raise the pawl arm 34 progressively, as the pawl is carried in a counterclockwise direction by the drive gear, so that ultimately the rocker plate 30 is released after being driven a short distance by the pawl.

Figure 5:
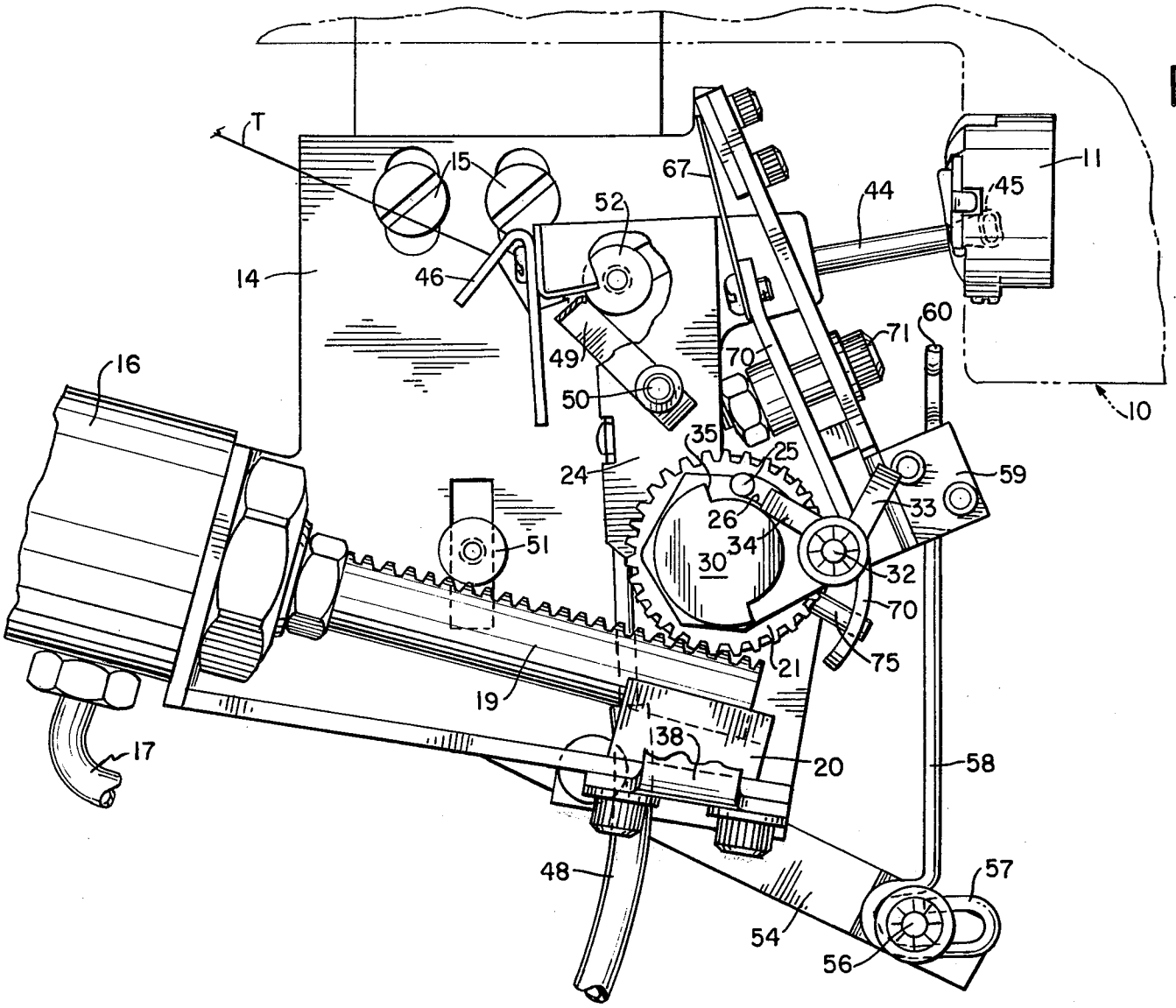
FIG. 5 is an elevational view, similar to FIG. 1, with parts of the mechanism shown in position for loading thread on to a bobbin spool.

At the initiation of a bobbin loading sequence, the actuator 16 is energized to retract the rod 18, rotating the drive gear 21 through a predetermined angle in a clockwise direction. At the commencement of this motion, the loading arm 24 initially is held in a counterclockwise retracted position, by means of a return spring 41 (FIG. 2) located on the back side of the mounting bracket 14 and engaging a pin 42 carried by the loading arm and extending through a slot 43 in the bracket. When driven in a clockwise direction, the drive gear 21 rotates for a short distance until the timing disc 23 is picked up, and the gear 21 and disc 23 then rotate together for a further short distance until the loading arm is picked up. Thereafter, the gear, disc and arm rotate together throughout the balance of the retracting stroke of the cylinder rod. When the actuator has completed its retracting stroke, the loading arm 24 will have been pivoted to a position shown in FIG. 5, in which a hollow loading tube 44, carried by the loading arm, projects into a cut-out opening (not shown) in the side of the bobbin case 11. The bent-around end extremity 45 of the loading tube is then facing the hub area of the bobbin spool, in position to discharge thread directly at the bobbin spool for entangling engagement with the spool hub.

As shown particularly in FIG. 1, the loading tube 44 is seated within a tubular passage 45 in the loading arm and is arranged to receive a thread T extending from a bulk source (not shown) through a thread guide 46, into the passage 45 and through the loading tube. The loading tube is sufficiently large at its inlet end to receive with clearance a small air discharge tube 47. The tube 47 communicates through a flexible line 48 and pressure reducing valve (not shown) with the actuator-valved air supply line 17. The arrangement is such that, upon initiation of the retracting motion of the actuator rod, low pressure air is supplied through the loading tube, urging the thread to advance through the tube. At the same time, high pressure air is directed through the tube 13 for driving the bobbin spool at high speed.

The fully extended position of the actuator rod 18 is generally as indicated in broken lines in FIG. 1. During the initial retracting movement of the actuator rod, to the position show in full lines in FIG. 1, the loading arm 24 remains stationary. There is no movement of the thread through the loading tube during this interval, because the thread is clamped in the loading arm by means of a clamping lever 49 pivoted at 50 on the loading arm and pressed against the thread by a stop lug 51 carried by the mounting bracket. As the actuator rod moves to its fully retracted position, shown in FIG. 5, the loading arm 24 is quickly brought into a loading position, where thread end is directed by the air flow from the loading tube 44 on to the hub of the bobbin spool, which is rotating at high speed. When the loading arm 24 is in its active or loading position, indicated in FIG. 5, the brake lever 49 is pressed into a thread-releasing position, by means of a second stop lug 52 mounted on the bracket. Once the thread end, extending from the loading tube 44, is entangled with the spool hub, the high speed rotation (e.g., several thousand rpm) of the bobbin spool serves to wind thread onto the spool in an extremely short time. By means of control circuit arrangements to be described hereinafter, the supply of a predetermined length of the thread T onto the bobbin spool executes a control function, which serves to stop the thread T by means of a solenoid actuated brake, and initiates a reverse movement of the actuator rod 18.

During the reverse or extending movement of the actuator rod 18, the following functions are performed in sequence: The loading arm and tube are withdrawn from the bobbin case, the thread is re-clamped in the loading arm, the intact thread extending from the loading arm to the bobbin spool is manipulated to bring the thread under a tesnion spring on the bobbin case, and the thread is then severed between the loading tube and the bobbin case, to permit a new sewing sequence to commence. It should be understood, in this respect, that the entire series of actions involved in the retraction and extension of the actuator rod 18, and the performance of all the operations involved in the reloading of the bobbin, occur within a very short time, less than a second in most instances.

When extending movement of the actuator rod is commenced, the drive gear 21 is rotated in a counterclockwise direction. Although the relationship of the pins 25, 27 to their respective arcuate slots 26, 28 in the drive gear and timing disc does not result in positive driving of the loading arm 24, the latter is nevertheless returned to its initial position by the action of the return spring 41. The thread T remains under tension, being gripped by a solenoid brake at the bulk supply end and being held under stalled torque of the bobbin spool, which is still influenced by the turbine air discharge. When the loading arm 24 reaches its starting position, the clamping lever 49 engages the stop lug 51, and the thread is firmly clamped in the loading arm.

Approximately at the time that the loading arm reaches its starting position, the driving arm 34 of the pawl lever 33 engages the shoulder 35 of the rocker plate. Continued counterclockwise rotation of the drive gear 21 thereupon causes counterclockwise rotation of the rock shaft 29 and pivoting of the rocker arm 31. This continues for perhaps 10° or so of rotation of the drive cam, until the riser surface 40 lifts the drive arm 34 off of the shoulder 35. The rocker arm 31 and shaft 29 are then returned to their initial positions by the return spring 41, as will appear.

Figure 6:
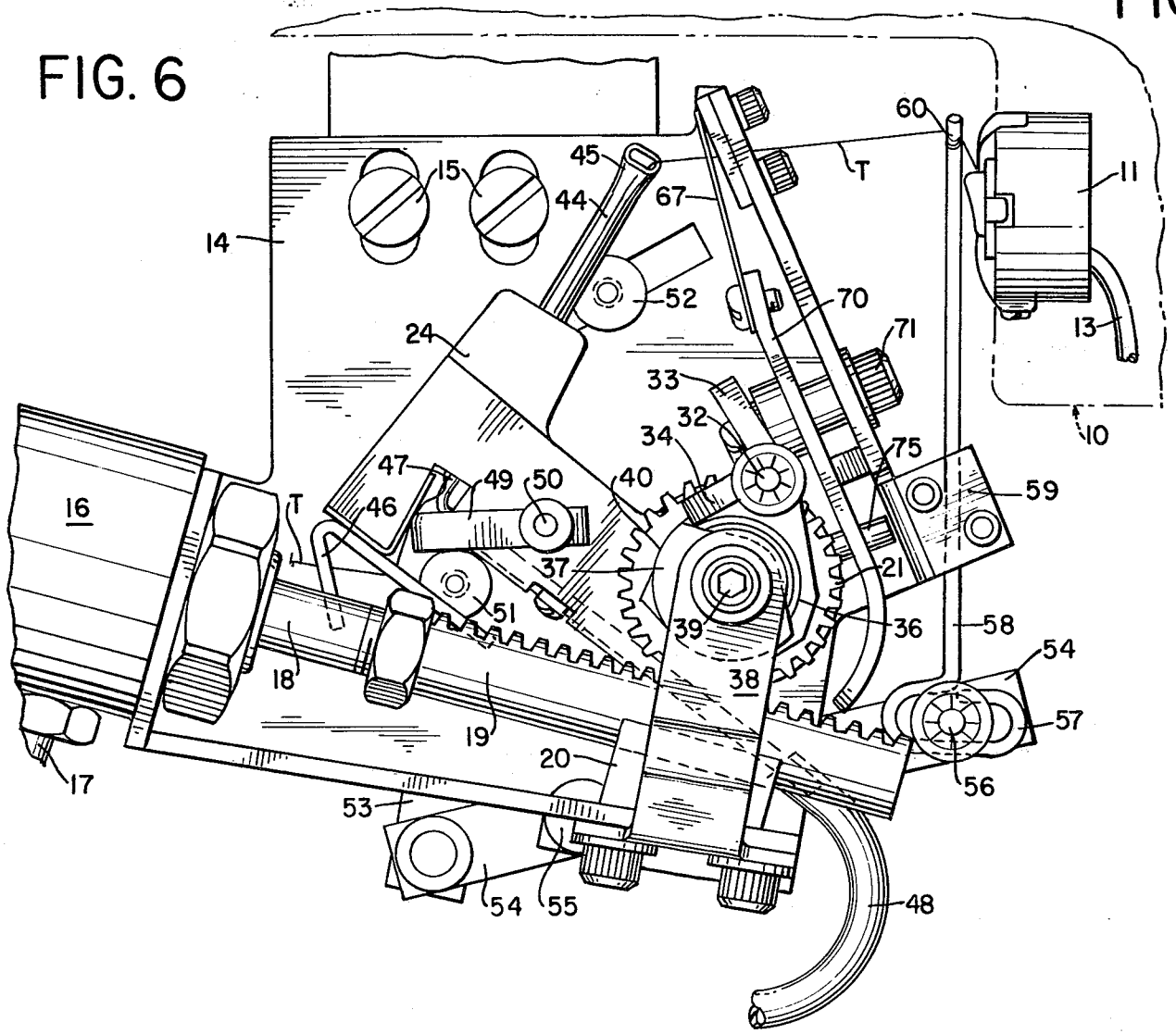
FIG. 6 is an elevational view, similar to FIGS. 1 and 5, illustrating the mechanism immediately after loading of thread on to a bobbin spool, with the thread being manipulated into position under the tension spring.

Connected to the rocker arm 31, by means of a connecting link 53, is a lifting lever 54, which is pivoted at 55 on the primary mounting plate. At its outer end, the lifting lever 54 carries a pin 56 which is slideably associated with an elongated eye 57 formed in a generally vertically disposed thread manipulating wire 58. The wire 58 is slideably guided in a bearing block 59 and has an upwardly opening hook portion 60 at its upper end which underlies the path of the thread extending between the bobbin case 11 and the retracted feed tube 44. As reflected in FIGS. 2, 3 and 6, for example, the initial position of the upper end of the manipulating wire is initially below the bobbin case 11. During the extending stroke of the actuator rod 18, when the rocker arm 31 is pivoted through its arc of rotation, the lifting lever 54 is pivoted upwardly, carrying the hook-like upper end 60 of the manipulating wire upward into contact with the thread T and thence upward further a short distance, to displace the thread upwardly. At this juncture, the thread is clamped in the loading arm and is being held by the stalled bobbin spool, such that the thread is maintained under at least limited tension. Accordingly, when the thread is displaced upwardly by the manipulating wire 58, the portion 61 of the thread which is adjacent the bobbin case 11 is carried underneath a pressure finger 62 formed on a bobbin thread tension spring 63. Opposite the tension finger 62 is a limiting tab 64, which projects into an opening 65 in the side wall of the bobbin case, and serves as a positive stop against further upward movement of the bobbin thread. After the bobbin thread has been displaced above the pressure finger 62, and then released by subsequent downward movement of the manipulating wire 58, the thread is confined to a narrow bight 66 in the end of the tension spring 63, being pressed against the side wall of the bobbin case by the pressure of the spring, in order to provide the desired bobbin thread tension.

As will be appreciated from the foregoing description, the rocker arm 31 is both displaced and subsequently released for return movement while the drive gear 21 continues to rotate unidirectionally in a counterclockwise manner. Return motion of the rocker arm is achieved by engagement of the return spring 41 with the inner end of the lifting lever 54 (FIG. 2).

After manipulating of the thread into its operative position under the tension spring 63, the thread is severed between the loading tube 44 and the bobbin case 11. In the illustrated apparatus, this is accomplished by means of a cutting knife 67 which cooperates with a cutting edge 68 carried by the mounting bracket 14. As illustrated particularly in FIG. 3, the mounting bracket 14 has an opening 69 therein which receives the loading tube 44 and through which the thread T passes in extendng from the loading tube to the bobbin spool. The cutting blade 67 is mounted on the end of a cutting arm 70, which in turn is pivoted on the mounting bracket 14 by means of a mounting screw 71.

Figure 9:
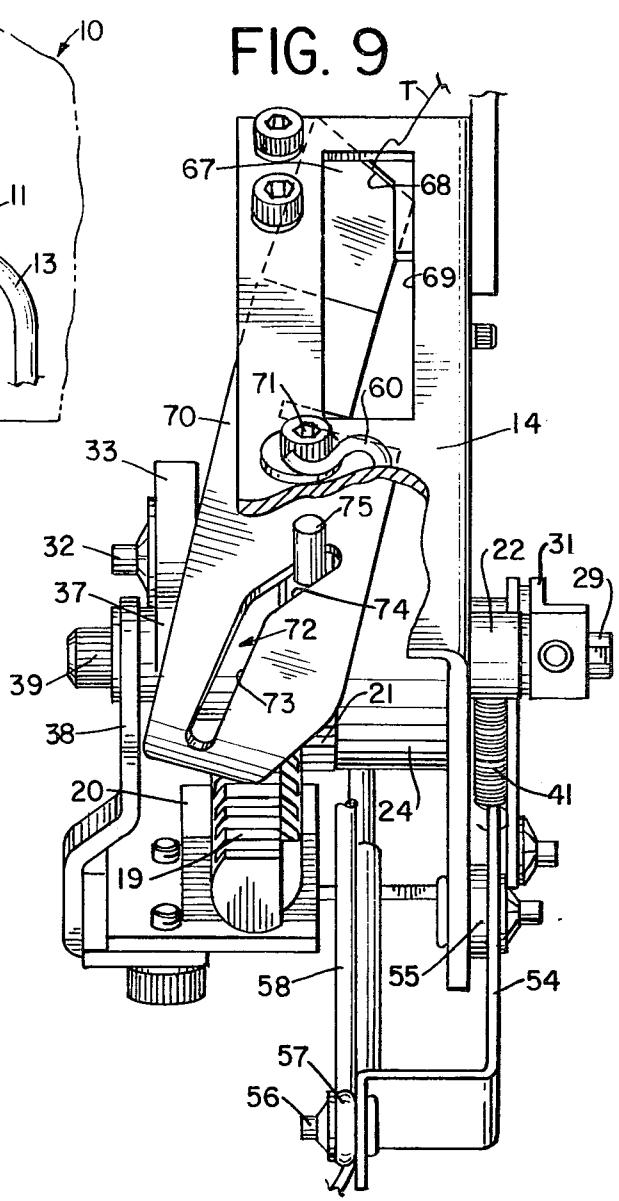
FIG. 9 is an end elevational view of the mechanism in the position shown in FIG. 8.
Figure 8:
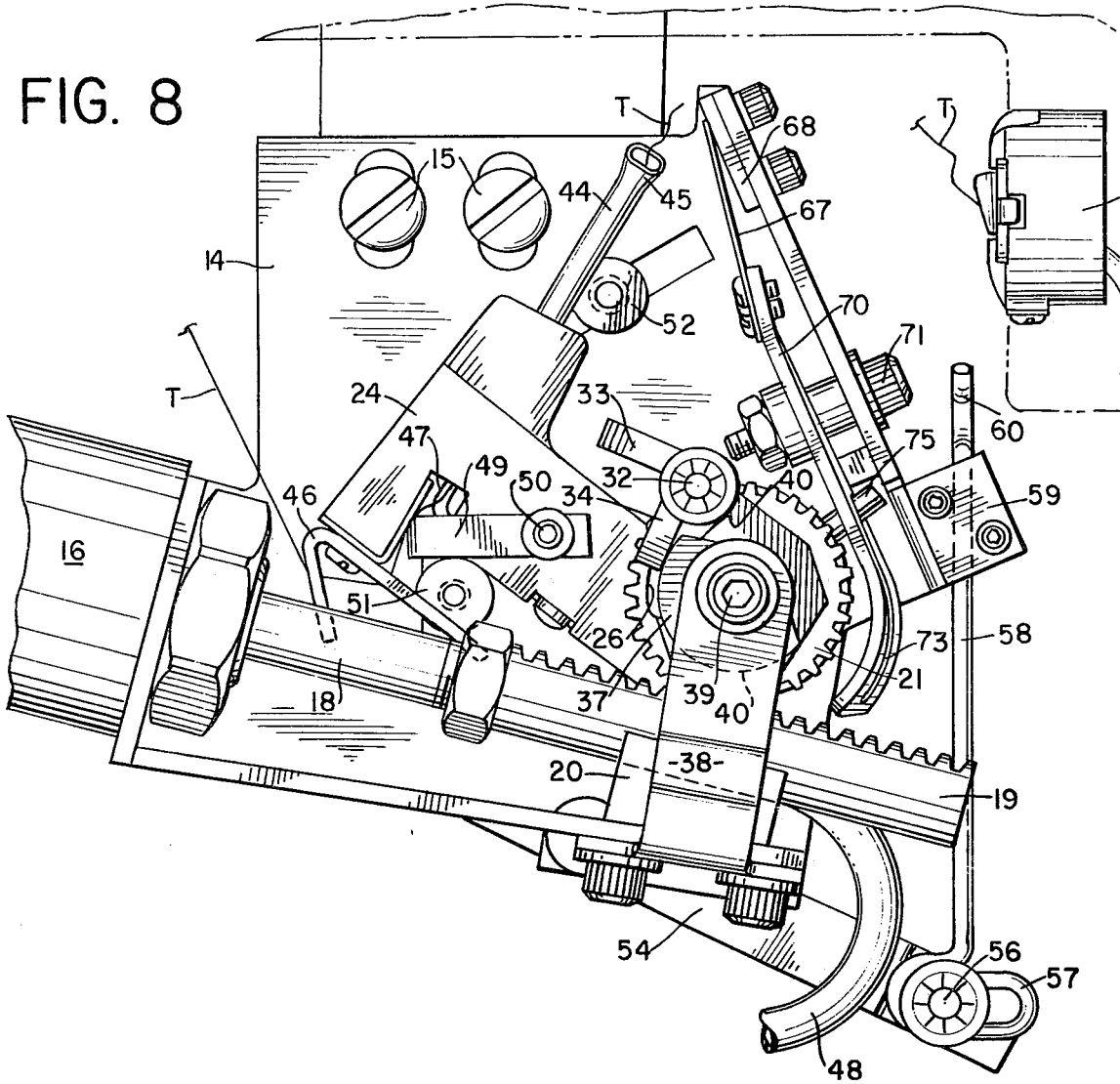
FIG. 8 is a further sequential view of the mechanism, shown in side elevation, immediately after cutting of the thread following a loading operation.

As reflected particularly in FIG. 9, the lower end of the cutting arm 70 is provided with an elongated cam slot 72, including a vertical lower portion 73 and an angularly disposed upper portion 74. The cam slot is of an appropriate size to closely receive a camming pin 75 extending radially from the timing disc 23, the arrangement is such that the movement of the cutting blade 67 is controlled by rotation of the timing disc 23.

During the retracting stroke of the actuator rod 18, clockwise rotation of the timing disc 23, without movement of the cutter arm 70, is accommodated by the vertical portion 73 of the cam slot. In other words, the rotational movement of the pin 75 does not effect lateral displacement of the cutting arm. Subsequently, during the extending movement of the actuator rod, the pin 75 first travels upwardly in the lower portion 73 of the cam slot. During this interval, the loading lever 24 is being retracted and the thread manipulating wire 58 is being actuated to place the intact thread under the bobbin tension spring 63. Thereafter, during continued counterclockwise rotation of the drive gear and timing disc, the camming pin 75 enters the angularly disposed upper portion 74 of the cam slot and displaces laterally the lower portion of the cutting arm 70, as reflected in FIG. 9. This brings the cutting blade 67 into shearing relation with the cutting bar 68 to sever the thread.

More or less simultaneously with the severing of the thread, the actuator rod 18 reaches the limit of its extending movement, closing the cylinder-contained air valve and terminating the flow of air to the turbine nozzle tube 13 and to the feeding tube 44. The mechanism holds in the just-described position as sewing proceeds, and is reactivated at the end of sewing of the next work unit, either automatically, or on the manual signal of the machine operator, more typically the former.

Of critical importance in the loading of the bobbin spool 12 is to assure the loading of a sufficient length of thread to enable the sewing of a given work unit to be completed, so as to avoid second quality product or, in some cases, the need for removing the partially completed sewing and re-performing the sewing operation. While this may be accomplished effectively by providing for substantial excess, this too is to be avoided, because it can represent a surprisingly large economic loss in a highly repetitive operation. To this end, the system of the present invention includes a simplified and economical, yet highly precise and effective circuit arrangement for measurement of the thread length, as it is being fed on to the spool during a loading operation. In this respect, the control arrangements of the present invention differ from those of the before mentioned Rovin U.S. Pat. No. 3,509,840 patent, in which a length of thread to be loaded on a spool is premeasured in advance of the loading operation. We have found it preferable to measure the thread length as it is being delivered on to the bobbin spool, in order to avoid an accumulation of slack thread in the supply system.

Figure 12:
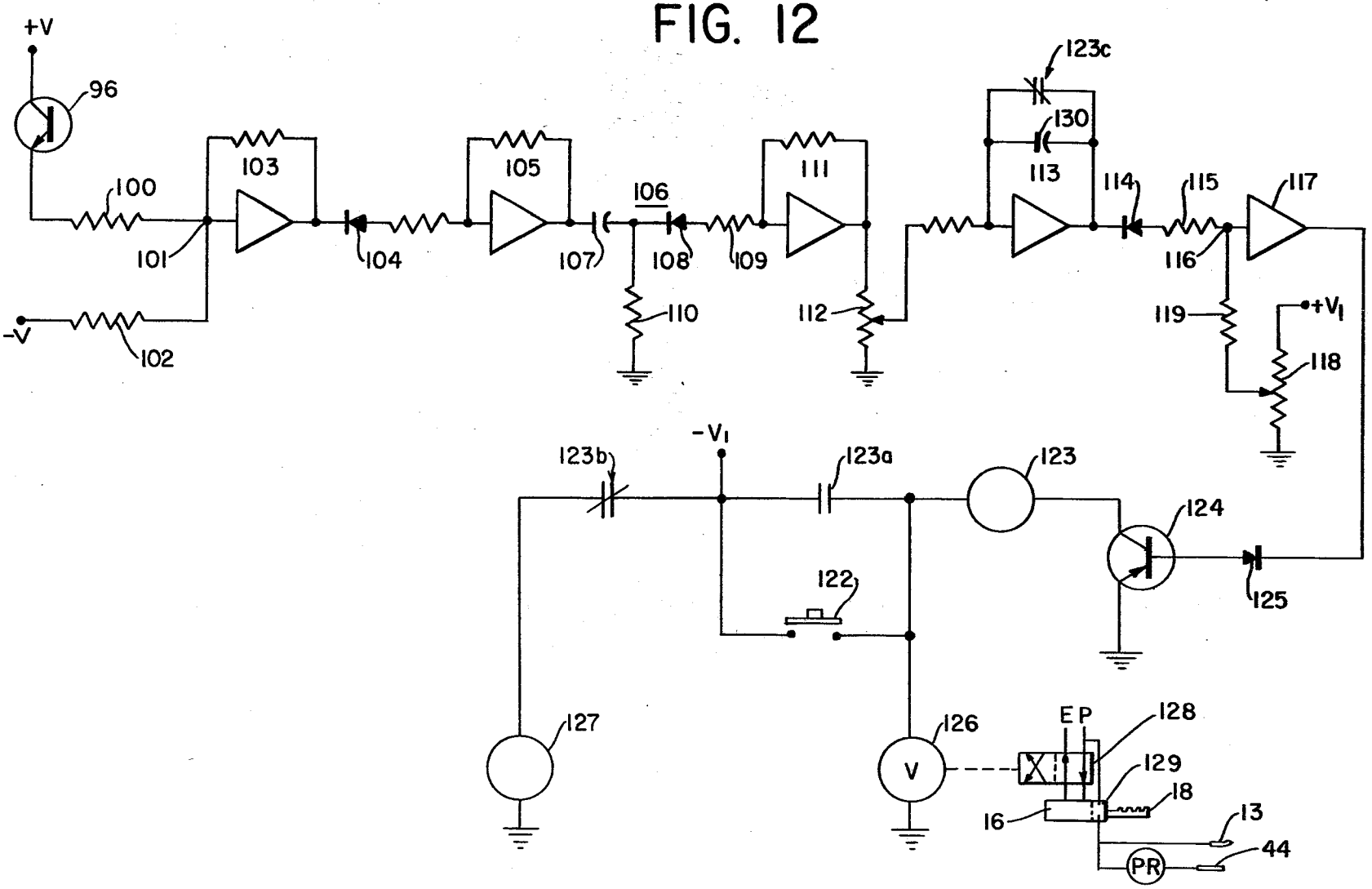
FIG. 12 is a simplified, schematic representation of a novel and advantageous form of control circuit utilized for precisely controlling the length of thread.

The control system of the invention is reflected in FIGS. 10–12 of the drawings. In FIG. 10, a bulk thread supply is designated by the reference numeral 90, and this may be in the form of a standard cone, for example. The thread is guided through a solenoid-actuated brake 91, and then is given a full turn around a measuring wheel 92, after which the thread is guided appropriately to the loading arm 24 of the feeding device. When thread is being wound onto the bobbin spool 12, the measuring wheel 92 is of course rotated in proportion to the linear advance of the thread.

The measuring wheel 92 desirably is of lightweight construction, to be as free as practicable of inertia. The wheel is mounted on a shaft 93 which also carries a uniformly slotted disc 94, the slotted edge of which operates in an area between a light source 95 and a photoelectric receptor device 96. Accordingly, the photoelectric receptor device is pulsed according to the number of slots passing the light source, which in turn is a direct function of the linear advance of the thread. By appropriate measurement of the number of such pulses, the increments of thread fed to the bobbin spool during a loading operation may be accurately measured and controlled.

While, theoretically, precise measurement of the thread increment may be achieved by merely counting the number of pulses generated by the photoelectric sensing device 96, standard counting circuits suitable for that purpose, and including provisions for a wide range of adjustment of the thread increment, are more costly than can be justified for the application involved. It is to be understood, in this respect, that the system of the invention, like any automation system, is commercially advantageous only to the extent that savings in material and time adequately exceeds capital and maintenance costs, making cost increment in the manufacture of the system a vital concern as regards the commercial utility thereof. Accordingly, pursuant to the present invention, a novel and advantageous circuit arrangement is provided, as illustrated in FIG. 12, which is advantageously cost effective and which provides for accurate, adjustable control of thread length in the loading operation.

With particular reference now to FIG. 12, the photoelectric sensing device 96, is connected at one side to a source of positive control voltage +V and at its other side to a voltage summing junction 101, through a resistor 100. Voltage generated by the photoelectric device 96 when exposed to successive pulses of light is unidirectional, varying between a minimum positive voltage, when light does not fall upon the device, and a greater positive voltage when the device is energized by a light pulse. Accordingly, a source of negative voltage −V is connected to the summing junction 101 through a resistor 102. The arrangement is such that the voltage at the summing junction will go through a polarity change with each pulse, swinging from negative to positive each time the device 96 is energized by a light pulse.

In the course of a thread loading operation, the slotted disc 94 rotates at varying speeds, due in part to the fact that the measuring wheel must go through an acceleration phase when thread movement commences. Accordingly, the signal pulses generated at the summing junction 101 will vary both as to amplitude and as to pulse width. For accurate pulse measurement, the circuit arrangement of the invention provides means for converting these variable pulses into pulses of consistent form, breadth, and amplitude, which may be conveniently and accurately integrated. For this purpose, the signal input at the junction 101 is directed through a relatively high-gain amplifier, which drives the pulse into a form approaching that of a square wave. The output of the first stage amplifier 103 is a signal of reversing polarity, and this signal is passed through a blocking diode 104 and then into a second high-gain amplifier 105. The second stage amplifier further drives the unidirectional pulses into greater conformity with the square wave form, providing signals with sharp, well defined wave fronts. The pulse output of the second stage amplifier 105 thus has a substantially constant form factor and a constant amplitude, but may vary in width as a function of the rotational velocity of the slotted disc 94.

The output of the second stage amplifier 105, constituting variable width, unidirectional pulses, is fed into a further pulse forming network 106, comprising a capacitor 107, diode 108 and resistor 109 connected in series, with a resistor 110 being connected to ground from the junction between the capacitor 107 and diode 108. This pulse forming network serves to create a pulse whose width is susbstantially constant over the range of frequencies encountered as a result of speed variation in the slotted disc 94. The output of the pulse forming circuit 106 thus is a unidirectional pulse of square form, having a uniform amplitude and width. This pulse is then fed through a further amplifier 111 to increase its energy content, and then is passed through a calibrating potentiometer 112.

The adjusted signal from the calibrating potentiometer 112 is supplied to an integrating circuit 113 which accumulates the signal pulses, developing an incrementally increasing output voltage as a direct function of the number of input pulses. The integrator 113 is conventionally arranged, including a DC operational amplifier with capacitor feedback. The output of the integrator circuit 113 is fed through a blocking diode 114 and resistor 115 to a summing junction 116 forming the input to an extremely high-gain amplifier 117. The integrated voltage signal thus supplied is of negative polarity. A positive voltage signal is also applied to the summing junction 116 from a voltage source +V, a potentiometer 118 and line resistor 119. The potentiometer 118 provides a positive comparison voltage, to be compared with the negative voltage output of the integrator circuit 113.

Initially, the output of the high-gain amplifier 117 is highly negative, inasmuch as the input voltage is primarily the positive voltage from the adjustable control potentiometer 118, the amplifier serving to invert the voltage polarity. During a thread loading operation, the voltage input through the amplifier 117 becomes progressively less positive, as successive increments of negative voltage are added to the output of the integrator circuit 113. At a predetermined point, corresponding to the loading on to the bobbin spool of the desired number of linear increments of thread, the voltage at the summing junction 116 becomes slightly negative, and the output of the high-gain amplifier 117 switches from negative to sharply positive, becoming stable in the positive condition.

At the commencement of a thread loading operation, a control switch 122 is momentarily closed, either manually or by an appropriate automatic control function on the sewing machine. An energizing circuit is completed through the coil 123 of a control relay, through a transistor 124 to ground. The transistor 124 is conductive at this time, by reason of the negative output voltage of the amplifier 117, applied through blocking diode 125 to the base electrode of the transistor. Upon energizing of the relay 123, holding contacts **123*a* thereof close, shunting the start switch 122, and normally closed contacts 123*b* and 123*c*** are opened.

Closing of the start switch 122 also energizes the solenoid 126 of an air valve 128, supplying actuating air to the rod end of the air actuator 16 to commence the mechanical aspects of the loading operation. Simultaneously, through opening of the contacts **123*b*, a solenoid 127, controlling the thread brake 91**, is de-energized to release the thread.

After its commencement, a thread loading operation will continue until the accumulated voltage output from the integrator circuit 113 equals the adjusted voltage from the control potentiometer 118, which has been preadjusted according to a desired thread length. When the voltage at summing junction 116 turns negative, the high-gain amplifier 117 becomes sharply positive, rendering the transistor 124 nonconductive and thus de-energizing the control relay 123. The following actions then take place: Relay contacts **123*a* open, de-energizing the air valve solenoid 126 and effecting a reversal of air flow to the actuator 16, such that pressure is applied to the head end of the actuator, to extend the rod 18. Relay contacts 123*b* close, energizing the brake solenoid and instantly stopping the movement of thread from the bulk supply. Pressure air continues to be supplied to the spool turbine nozzle 13 and to the loading tube 44, through the actuator-contained air valve designated 129 in FIG. 12. The valve 129 is closed when the actuator rod 18** has completed its extending stroke.

Simultaneously with the energizing of the control relay 123, a set of contacts **123*c* closes, shorting out the capacitor 130** of the integrator circuit. The integrator is thus discharged of its accumulated voltage and readied for a subsequent loading cycle.

The system of the present invention, while utilizing the important and fundamental principles of the Rovin U.S. Pat. No. 3,509,840 patent, constitutes a significant improvement thereover in terms of providing a rugged, compact, highly versatile mechanical device, which is easily adaptable to the several common commercially available forms of lock stitch type sewing machines presently marketed. This includes machines with horizontally disposed bobbins and with vertically disposed bobbins, and both single and double needle machines.

In conjunction with the important mechanical improvements, the system incorporates a novel and advantageous solid-state control circuit which, while providing a high degree of accuracy and reliability, is capable of fabrication on a basis well within the economic requirements of the system as a whole.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

We claim:

1. In an in-situ bobbin reloader of the type having (a) means for rotating the bobbin spool at high speed, (b) a feed tube movable into operative relation to said spool to guide thread onto said spool during reloading, (c) means supplying a measured length of thread during reloading, (d) a thread manipulator to engage the loaded thread under a bobbin tension spring, and (e) means for severing the loaded thread, the improvement which comprises (f) a mounting bracket for securing said reloader to a sewing machine, (g) a support sleeve mounted on said bracket, (h) a loading arm mounted on said sleeve for pivoting movement into and out of loading position and carrying said loading tube, (i) a drive gear mounted on said sleeve and having a lost motion driving engagement with said loading arm, and (j) an actuator mounted on said bracket and operatively associated with said drive gear for rotating the same to effect controlled pivoting movement of said loading arm into and out of loading position.

2. A bobbin reloader according to claim 1, further characterized by (a) said thread manipulator comprising an element mounted for movement across the face of the bobbin for engagement with a tensioned thread extending in a predetermined path from the bobbin in a direction generally parallel to the bobbin spool axis, (b) said loading arm, when in a retracted position, supporting said thread in said predetermined path, and (c) operating means connecting said thread manipulator to said drive gear whereby said manipulator is momentarily operated upon retraction of said loading arm.

3. A bobbin reloader according to claim 2, further characterized by (a) said operating means comprising a rock shaft rotatably supported within said sleeve, (b) spring means urging the rock shaft in a retracting direction, and (c) means for moving the rock shaft in an operating direction including a drive element actuated by said drive gear and means for effectively disengaging said drive element upon predetermined rotation of said rock shaft.

4. A bobbin reloader according to claim 3, further characterized by (a) said drive element comprising a pawl carried by said drive gear and engageable with a drive shoulder on said rock shaft, and (b) cam-like means for disengaging said pawl from said drive shoulder after partial rotation of said rock shaft and during unidirectional rotation of said drive gear.

5. A bobbin reloader according to claim 1, further characterized by (a) said severing means comprising a cutting arm mounted on said bracket for pivoting movement across said predetermined path, and (b) said cutting arm having camming means cooperating with camming means supported on said sleeve and driven by said drive gear, for effecting timed motion of said cutting arm.

6. A bobbin reloader according to claim 5, further characterized by (a) the camming means on said cutting arm comprising a cam slot, and (b) the camming means supported on said sleeve comprising a member rotatably mounted on said sleeve and having lost motion driving engagement with said drive gear.

7. A bobbin reloader according to claim 6, further characterized by (a) said rotatably mounted member having lost motion driving engagement with said loading arm, whereby said loading arm is driven by said drive gear through said rotatably mounted member.

8. A bobbin reloader according to claim 1, further characterized by (a) thread clamping means carried by said loading arm and adapted for pivotal movement into and out of thread clamping position, (b) a first stop member engageable with said clamping means in the retracted position of the loading arm to move and retain said clamping means in clamping position, and (c) a second stop member engageable with said clamping means in the loading position of said loading arm to open clamping means.

9. A bobbin reloader according to claim 2, further characterized by (a) said bobbin having its axis generally at right angles to a primary direction of motion of said thread manipulator, (b) said predetermined path of the thread extending from an opening in the side of the bobbin case, (c) said bobbin case having a thread tensioning spring extending along a portion of the bobbin case wall and spanning a portion of said opening, and (d) said thread tensioning spring having a bight portion in its free end for the reception of said thread upon displacement of the thread by said manipulator.

10. A bobbin reloader according to claim 9, further characterized by (a) the bight portion of said thread tension spring directly overlying a portion of the bobbin case wall and being defined by a pair of spaced spring portions, and (b) one of said spring portions pressing resiliently against the bobbin case wall to accommodate the displacement of the thread thereunder by said manipulator.

11. A bobbin reloader according to claim 10, further characterized by (a) the other of said spring portions being at least partly received in a recess in said bobbin case wall to preclude the passage of thread thereunder.

12. In combination with a bobbin thread loader of the type including (a) thread loading means, (b) actuator means for rendering said thread loading means operative in response to an actuating signal, (c) means responsive to said actuating signal for effecting rotation of a bobbin spool at high speed to wind thread onto said bobbin, and (d) control means for measuring and predetermining the thread length as it is fed onto the bobbin spool, the improvement in said control means which comprises (e) a measuring wheel driven by thread being drawn by the spool, (f) means associated with said measuring wheel for generating electric pulses corresponding to rotational movements of said wheel, (g) circuit means for shaping and forming said pulses to a sufficiently uniform condition for integration, (h) integrator circuit means for accumulating said pulses and thereby deriving an electrical signal proportional to the length of thread passing said measuring wheel, (i) adjustable circuit means providing a predetermined voltage signal for comparison with said proportional signal, and (j) control means for terminating a thread loading operation when said proportional signal reaches a predetermined relation to said predetermined signal.

13. Control means according to claim 12, further characterized by (a) said means for generating electrical pulses comprising a slotted disc and a photoelectric receptor and light source means on opposite sides of said disc, and (b) said means for shaping and forming comprising means for amplifying the pulse to uniform amplitude and generally square wave form and means for expanding the pulse to uniform width.

14. Control means according to claim 12, further characterized by (a) the said control means for terminating a thread loading operation comprising a high-gain amplifier, (b) the accumulated pulses of said integrator circuit forming one input to said high-gain amplifier, and (c) said adjustable circuit means forming a second input of opposite polarity to said high-gain amplifier.

15. Control means according to claim 14, further characterized by (a) a switching transistor controlled by the output of said high-gain amplifier, and (b) a control relay controlled by said switching transistor.

16. A control circuit for controlling the feeding of thread in an in-situ bobbin reloader, which comprises (a) a control relay for controlling mechanical operations of the reloader including a thread brake and a bobbin drive, (b) means for deriving pulses of possibly varying size in response to the feeding of predetermined linear increments of thread to the bobbin, (c) circuit means including amplifier means for converting said pulses to square wave form of uniform amplitude and width, (d) means for integrating successive ones of said pulses, (e) circuit means for summing the thus integrated pulses with an adjustable control voltage of opposite polarity, and (f) polarity responsive means associated with said last mentioned circuit means for changing the actuated condition of said control relay in response to a change in polarity of the sum of said pulses and control voltage.

17. A control circuit according to claim 16, further characterized by (a) said polarity responsive means comprising a high-gain amplifier and a switching transistor whose base electrode is connected to the output of said high-gain amplifier.

* * * * *